US006793156B2

(12) United States Patent
Dobbs et al.

(10) Patent No.: US 6,793,156 B2
(45) Date of Patent: Sep. 21, 2004

(54) ORIFICE CUP FOR MANUALLY ACTUATED SPRAYER

(75) Inventors: Douglas B. Dobbs, Yorba Linda, CA (US); Joseph Nazari, La Crescenta, CA (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 243 days.

(21) Appl. No.: 10/084,195

(22) Filed: Feb. 28, 2002

(65) Prior Publication Data

US 2003/0160113 A1 Aug. 28, 2003

(51) Int. Cl.[7] ..... B05B 1/34

(52) U.S. Cl. ..... 239/492; 239/343; 239/461; 239/463; 239/490; 239/491

(58) Field of Search ..... 239/492, 343, 239/461, 463, 468, 475, 487, 489, 490, 491, 493; 222/148, 321.1, 321.2, 342

(56) References Cited

U.S. PATENT DOCUMENTS 4,051,983 A * 10/1977 Anderson ..... 222/321.2
4,941,595 A * 7/1990 Montaner et al. ..... 222/321.2
5,638,996 A * 6/1997 Montaner et al. ..... 222/321.2
6,158,625 A * 12/2000 Siegel et al. ..... 222/148

* cited by examiner

*Primary Examiner*—Davis Hwu
(74) *Attorney, Agent, or Firm*—Dykema Gossett PLLC

(57) ABSTRACT

A manually actuated sprayer has an orifice cup with a reverse taper mounted within a cylindrical bore of the discharge passage for positively retaining the orifice cup in place without dislodgement during spray actuation.

6 Claims, 1 Drawing Sheet

ORIFICE CUP FOR MANUALLY ACTUATED SPRAYER

BACKGROUND OF THE INVENTION

This invention relates generally to manually actuated sprayers, and more particularly to such sprayers having an orifice cup with a discharge orifice through which product is dispensed upon sprayer actuation.

The known orifice cup is mounted within the discharge passage of manually actuated hand-held sprayers, the cup being normally held in place as its cylindrical side wall is press fitted within the wall of a circular bore for tight frictional engagement therewith. Spin mechanics in the form of a spin chamber and tangentials leading thereto may be formed on the inner surface of the circular base wall of the orifice cup. Upon manual actuation of the sprayer as, for example, a pump sprayer actuated by depressing a plunger head or such as a trigger actuated sprayer actuated by the squeezing of the trigger, significant pressures are developed as the liquid product is forced through a constricted discharge passage and through the spin mechanics before issuing through the discharge orifice in the form of a spray. Of course, with no spin mechanics provided or with an immobilized spin mechanics feature, the liquid issues from the discharge orifice in the form of a stream.

The known orifice cup is molded as having a cylindrical skirt wall, and an annular retention bead projecting radially outwardly of the side of the cup near the front end thereof. The orifice cup is typically force fitted within the cylindrical bore at the terminal end of the discharge passage in tight frictional engagement between the cylindrical side wall of the cup and the cylindrical bore wall. The annular retention bead is designed to project into the confronting cylindrical portion of the pump sprayer body serving to assist in retaining the orifice cup in place within the bore as well as in acting as a seal between the orifice cup and the bore of the discharge passage.

Occasionally the orifice cup will dislodge from its bore upon persistent high pressures acting on its underside surface during sprayer actuation. When this occurs the orifice cup may be shifted sufficiently downstream such that its annular retention/sealing bead moves out of its mating groove and even out of the terminal end of the bore. Thus, the seal between the orifice cup and the wall of the bore is disturbed thereby opening up a passage, however, minute, for liquid to leak through. This presents an unsightly and totally unacceptable condition.

Also where spin mechanics is formed on the inner surface of the base of the orifice cup which cooperates with a confronting probe on the sprayer body which extends into the cup, any slight shifting movement of the orifice cup in a downstream direction in response to the high pressure exerted will cause both leakage of product and may defeat the ability of the spin mechanics to function to swirl the product and break it up into a fine mist spray.

The need therefore arises for improvement upon the retentivity and the sealability of the orifice cup within its bore.

SUMMARY OF THE INVENTION

It is therefore an object of the present invention to provide an orifice cup for a manually actuated sprayer which is positively retained in place against dislodgement and is sealed in its bore against leakage in a manner requiring but a minor modification thereby incurring little costs for the same yet is highly efficient in improving upon the retentivity and sealability of the orifice cup in its bore.

In keeping with this objective, the orifice cup according to the invention has its skirt molded to frusto-conical shape tapering outwardly in an upstream direction of flow through the orifice. The circular base of the orifice cup has an outer diameter substantially the same as the wall diameter of the discharge bore. The cup skirt wall tapers radially outwardly relative to that outer diameter such that when force fitted into its bore the entirety of the skirt wall bears tightly and sealingly against the bore wall for both positively retaining the orifice cup in place without the likelihood of dislodgement due to pressure forces of the discharged fluid, and for sealing the orifice cup in its bore without the likelihood of any leakage from around the cup.

Other objects, advantages, and novel features of the invention will become more apparent from the following detailed description of the invention when taken in conjunction with the accompanying drawings.

DETAILED DESCRIPTION OF THE INVENTION

Figure 1:
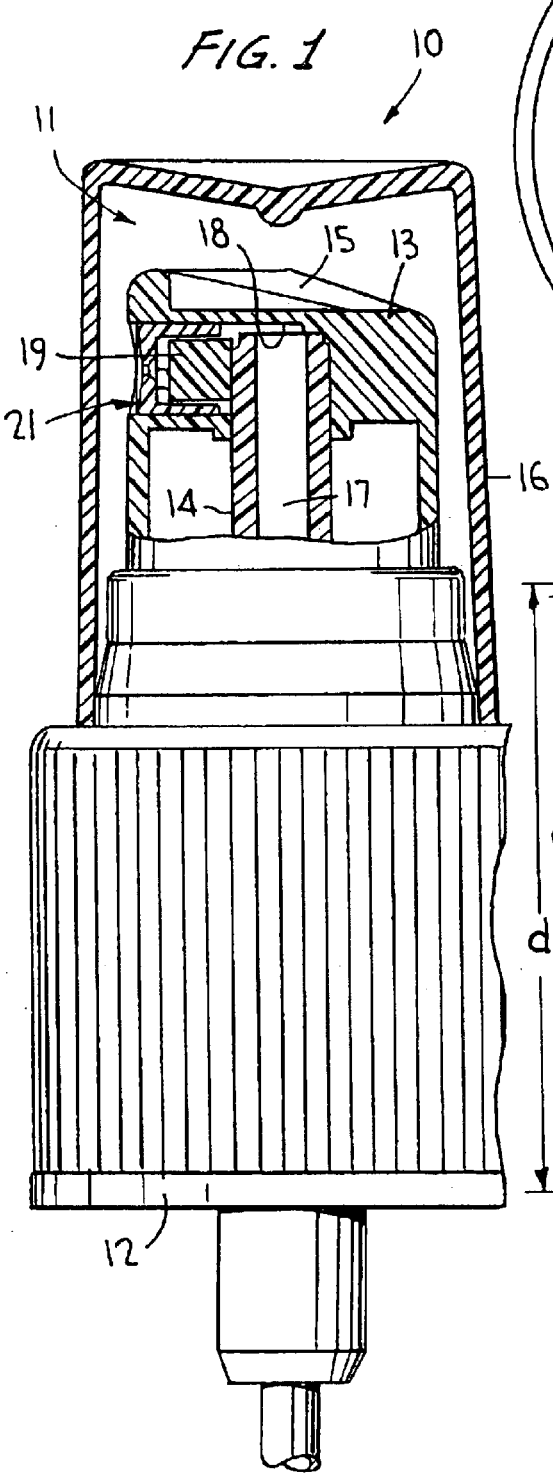
FIG. 1 is a side view, partly in section, of a manually actuated sprayer with its sprayer head incorporating the improved orifice cup according to the invention.
Figure 2:
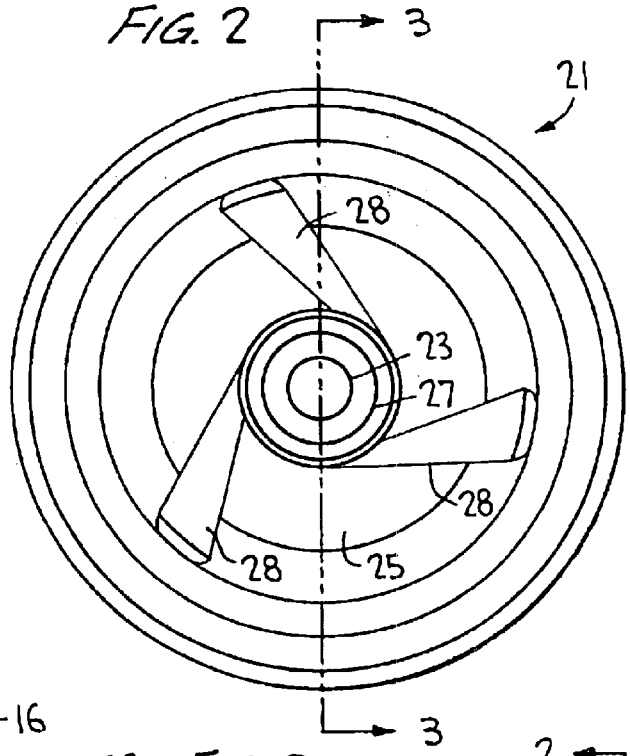
FIG. 2 is a view taken substantially along the line 2—2 of FIG. 3.

Turning now to the drawings wherein like reference characters refer to like and corresponding parts throughout the several views, a manually actuated sprayer is generally designated 10 in FIG. 1 which is in the form of a pump sprayer as represented by the type disclosed in U.S. Pat. No. 4,051,983, commonly owned herewith, and being specifically incorporated herein by reference. Of course any other type of manually actuated hand-held sprayer is capable of incorporating the invention, such a trigger actuated pump sprayer, an aerosol sprayer, a squeeze bottle sprayer, etc.

Sprayer 10 has a body member 11 which includes a closure 12 for mounting the sprayer to a container (not shown) of product to be sprayed. The body member further includes a plunger head 13 mounted on a hollow plunger stem 14, which stem has a pump piston (not shown) reciprocable within a pump cylinder (not shown) in a manner known in this art upon the application of external finger pressure applied to top 15 of the plunger head. An overcap 16 is of course first removed by the operator before the plunger is reciprocated.

The piston stem defines a discharge passage 17 which communicates with a transversely extending hollow cylindrical bore 18 provided in the head. The plunger head has a cylindrical probe 19 extending transversely and coaxially with bore 18.

Orifice cup 21 in accordance with the invention is similar in many respects to that disclosed in the 4,051,983 patent in that it is thimble-shaped having a base wall 22 containing a discharge orifice 23 through which the liquid product issues in the form of a fine mist spray as known in this art. The base wall has an outer diameter which is substantially the same as or slightly greater than the diameter of the wall of cylindrical bore 18 in its relaxed condition. An annular retention bead 24 is formed integrally with the orifice cup and extends radially outwardly of the side wall of the base at an enlarged diameter d compared to the outer diameter of the base wall. Likewise an inner face 26 of the base wall is formed with the known spin mechanics 26 which includes a spin chamber 27 coaxial with the discharge orifice and a plurality (usually 3) tangential channels 28 leading into the spin chamber for imparting the swirl to the liquid in the spin chamber causing the liquid to emerge from the orifice in the form of a fine mist spray.

Orifice cup 21 further has an integrally molded skirt 29, probe 19 extending into the hollow of the skirt when the orifice cup is installed in cylindrical bore 18. The diameter of the probe is slightly less than the inner diameter of the skirt defining an annular gap 31 defining an extension of discharge passage 17. Alternatively, axial ribs or grooves can be provided on the confronting walls of probe 19 and/or bore 18. And the probe has a flat terminal end 32 which confronts channels 28 so as to define tangential flow passageways therewith. In thus manner, and as well known in this art, after the pump is primed with liquid, each downward stroke applied to the plunger head pressurizes the liquid in the pump chamber (not shown) and forces liquid under pressure through an open discharge valve (not shown) along discharge passage 17, gap 31, and tangentials 28 which subject the liquid to a vortex in spin chamber 27 causing the swirled liquid to issue through the discharge orifice 23 in the form of a fine mist spray.

Figure 3:
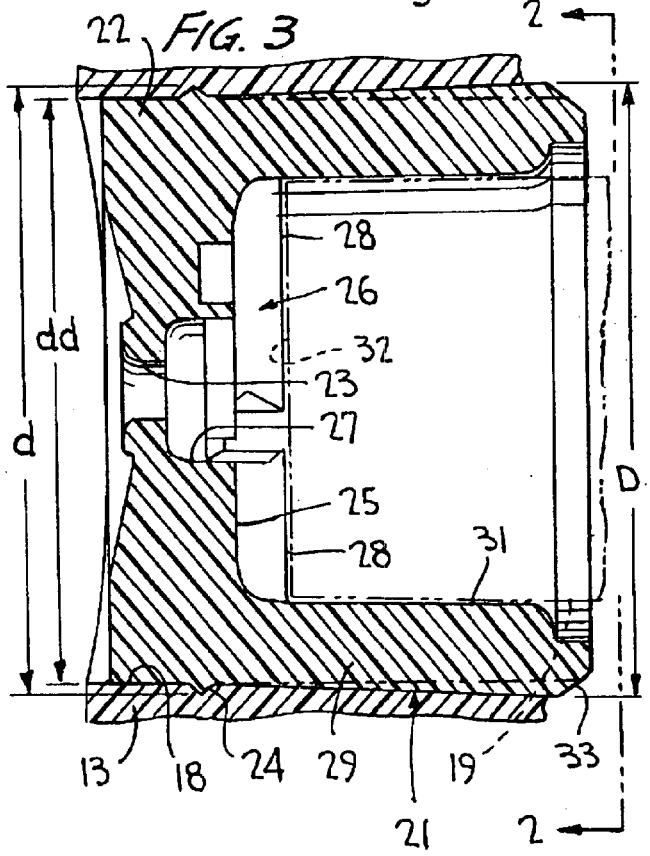
FIG. 3 is a sectional view taken substantially along the line 3—3 of FIG. 3 of the orifice cup according to the invention at an enlarged scale.

Specifically in accordance with the invention, skirt 29 is molded into a frusto-conical shape as shown in detail in FIG. 3. Thus, the outer wall of skirt 29 tapers radially outwardly in an upstream direction of flow from diameter d at base 22, to a maximum outer diameter D adjacent the free end of the skirt. This maximum diameter D is substantially the same as diameter dd of retention bead 24, and assists in more easily removing the molded part from the mold. Also it is noted that the free end of the skirt may be chamfered as at 33 to more easily facilitate insertion of the orifice cup within cylindrical bore 18

As an example of several of the dimensions involved, without limiting the invention in any manner, diameter d can be 0.179 inches, diameters dd and D can be 0.185 inches, and the length of the reverse taper of the skirt can be 0.096 inches.

The orifice cup is inserted into cylindrical bore 18 of the plunger head in any normal manner known in this art. The plastic material chosen for the plunger head is sufficiently forgiving such that the orifice cup with its reverse taper is forced fitted into the cylindrical bore 18 without inducing any cracking in either the orifice cup or in the plunger head. The tight frictional fit effected between the orifice cup and the wall of the cylindrical bore has been shown to positively retain the orifice cup in place without dislodgement even after repeated pump strokes subjecting the inner face 25 of the cup to fluid pressures even exceeding those which would normally occur in practice. The reverse taper of the skirt functions to not only vastly improve upon the tight frictional engagement with the cylindrical bore wall, but functions to avoid any leakage of product at the inner face between the cap skirt and the wall of bore 18.

Retention bead 24 is optional and may be provided as an additional means of retention of the orifice cup in place.

Although the present invention has been described with reference to a fingertip actuated pump sprayer, it is not so limited, but is rather likewise fully adaptable to an aerosol sprayer, a trigger actuated pump sprayer, a squeeze bottle sprayer, etc., within the scope of the invention. The reverse taper of the orifice cup skirt functions equally well in all these type sprayers to retain the orifice cup positively in place within its cylindrical bore without dislodgement even under extreme and repeated high pressures of the dispensed fluids.

Obviously, many modifications and variations of the present invention are made possible in the light of the above teachings. It is therefore to be understood that within the scope of the appended claims the invention may be practiced otherwise than as specifically described.

What is claimed is:

1. A manually actuated sprayer comprising, a body member having a discharge passage terminating in a discharge orifice through which liquid product issues on sprayer actuation, an orifice cup mounted within the discharge passage, the orifice cup comprising a base wall with an integral skirt extending in an upstream direction relative to passage of the liquid product, said discharge passage including a cylindrical bore of a predetermined wall diameter, the base wall of the orifice cup containing the discharge orifice and the base wall having an outer diameter substantially the same as said predetermined wall diameter, an outer wall of the skirt being frusto-conical and tapering outwardly in the upstream direction from the base wall to a free end of the skirt such that the maximum diameter of the outer wall exceeds said predetermined diameter, the outer wall of the skirt sealingly engaging the wall of the cylindrical bore for positively retaining the orifice cup within the bore and preventing any passage of the liquid product between the outer wall of the skirt and the wall of the cylindrical bore.

2. A manually actuated sprayer comprising, a body member having a discharge passage terminating in a discharge orifice through which liquid product issues on sprayer actuation, an orifice cup mounted within the discharge passage, the orifice cup comprising a base wall with an integral skirt extending in an upstream direction relative to passage of the liquid product, said discharge passage including a cylindrical bore of a predetermined wall diameter, the base wall of the orifice cup containing the discharge orifice and the base wall having an outer diameter substantially the same as said predetermined wall diameter, an outer wall of the skirt being frusto-conical and tapering outwardly in the upstream direction such that the maximum diameter of the outer wall exceeds said predetermined diameter, the outer wall of the skirt sealingly engaging the wall of the cylindrical bore for positively retaining the orifice cup within the bore and preventing any passage of the liquid product between the outer wall of the skirt and the wall of the cylindrical bore, and the orifice cup having an annular retention bead projecting radially outwardly of a side of the base wall into engagement with the wall of the cylindrical bore for further positively retaining the orifice cup within the bore.

3. The sprayer according to claim 2, wherein the retention bead has an outer diameter substantially equal to the maximum diameter of the outer wall.

4. A manually actuated sprayer comprising, a body member having a discharge passage terminating in a discharge orifice through which liquid product issues on sprayer actuation, an orifice cup mounted within the discharge passage, the orifice cup comprising a base wall with an integral skirt extending in an upstream direction relative to passage of the liquid product, said discharge passage including a cylindrical bore of a predetermined wall diameter, the base wall of the orifice cup containing the discharge orifice and the base wall having an outer diameter substantially the same as said predetermined wall diameter, an outer wall of the skirt being frusto-conical and tapering outwardly in the upstream direction such that the maximum diameter of the outer wall exceeds said predetermined diameter, the outer wall of the skirt sealingly engaging the wall of the cylindrical bore for positively retaining the orifice cup within the bore and preventing any passage of the liquid product between the outer wall of the skirt and the wall of the cylindrical bore, and the body member having a cylindrical probe extending into the orifice cup toward the base wall to define spin mechanics means together with a confronting surface of the base wall.

5. The sprayer according to claim 4, wherein a liquid passageway is defined between the probe and the wall of the bore in communication with the mixing chamber means.

6. The sprayer according to claim 4, wherein the spin mechanics means comprise tangential grooves leading into a spin chamber, an end surface of the probe overlying the grooves to define tangential passages.

* * * * *